United States Patent [19]

Inagaki

[11] Patent Number: 4,771,715

[45] Date of Patent: Sep. 20, 1988

[54] ZIGZAG SEWING MACHINE

[75] Inventor: Hidetaka Inagaki, Nagoya, Japan

[73] Assignee: Brother Kogyo Kabushiki Kaisha, Nagoya, Japan

[21] Appl. No.: 98,526

[22] Filed: Sep. 18, 1987

[30] Foreign Application Priority Data

Sep. 30, 1986 [JP] Japan ..... 61-150808[U]

[51] Int. Cl.[4] ..... D05B 3/02

[52] U.S. Cl. ..... 112/443

[58] Field of Search ..... 112/443, 221, 220, 189, 112/190, 181, 182, 184, 185, 191, 73

[56] References Cited

U.S. PATENT DOCUMENTS 2,662,495 12/1953 Parry ..... 112/221 X 4,425,859 1/1984 Ishitani ..... 112/443

FOREIGN PATENT DOCUMENTS 0145888 11/1981 Japan ..... 112/443

*Primary Examiner*—Peter Nerbun

*Attorney, Agent, or Firm*—Koda and Androlia

[57] ABSTRACT

A zigzag sewing machine includes a frame, a needle bar supporting member mounted on the frame for swinging motion about a horizontal fixed axis, and a needle bar carried by the needle bar supporting member for endwise reciprocation. A rotary member is rotatably supported by the frame for rotary motion about an axis parallel to the horizontal fixed axis, and a connecting rod is connected eccentrically and pivotally at the upper end thereof to one side of the rotary member. The connecting rod is connected pivotally at the lower end thereof to the needle bar at a position below the upper end. At a moment when the shuttle hook of a shuttle catches a loop, the upper end of the connecting rod and the shuttle hook of the shuttle move in a direction opposite to the direction of swinging motion of the needle bar supporting member. When the shuttle hook catches a loop, the lower end of the connecting rod is located above the horizontal fixed axis about which the needle bar supporting member swings. Accordingly, when the shuttle hook catches a loop with the needle located at the opposite ends of its lateral swinging motion range, the needle is located at substantially the same height.

4 Claims, 4 Drawing Sheets

ZIGZAG SEWING MACHINE

FIELD OF THE INVENTION

The present invention relates generally to a zigzag sewing machine and more particularly, it relates to such a zigzag sewing machine having a needle bar supporting member supporting a needle bar and adapted for swinging motion about a fixed horizontal axis, and a rotary member which is rotated about an axis parallel to the fixed horizontal axis to drive the needle bar through a connecting rod for endwise reciprocation.

BACKGROUND OF THE INVENTION

A zigzag sewing machine of this type is disclosed in, for example, Japanese Laid-Open(Kokai) Patent Publication No. 56-145888.

As shown in FIG. 4, in this known zigzag sewing machine, the respective motions of a rotary member 9 and a shuttle 15 are timed so that the junction 13 of the rotary member 9 and a connecting rod 12, and the shuttle hook 15*a* of a shuttle 15 move in the same direction a that of the swinging motion of a needle bar supporting member when the shuttle hook 15*a* of the shuttle 15 catches a loop formed in the eye of a needle 8. A horizontal fixed shaft 4 on which the needle bar supporting member swings is disposed so that the junction 14 of a needle bar 7 and a connecting rod 12 is located below the horizontal fixed shaft 4 at a moment when the shuttle hook 15*a* catches a loop. Thus, the difference h1 is minimized between the height of the needle 8 at one end of its swinging motion and the height of the same at the other end of the swinging motion, where the shuttle hook 15*a* catches a loop, in order to enable the shuttle hook 15*a* to encounter the needle 8 at optimum positions.

This known zigzag sewing machine, however, needs an inverting mechanism to rotate the rotary member 9 and the shuttle 15 in opposite directions, respectively, and hence the zigzag sewing machine has a complicated construction and many component parts.

OBJECTS OF THE INVENTION

Accordingly, it is an object of the present invention to provide a zigzag sewing machine having a rotary member to drive a needle for endwise reciprocation and a shuttle which are rotated in the same direction, and capable of positioning the needle at a substantially fixed height both when the shuttle hook catches a loop with the needle positioned at one end of its swinging motion range and when the shuttle hook catches a loop with the needle positioned at the other end of the swinging motion range so that the shuttle hook is able to encounter the needle at an optimum position.

SUMMARY OF THE INVENTION

The zigzag sewing machine includes, according to the present invention, a frame, a needle bar supporting member mounted on the frame for swinging motion about a horizontal fixed axis, a needle bar carried by the needle bar supporting member for endwise reciprocation, a needle carried at the lower end of the needle bar and having a thread eye, a rotary member mounted on the frame and driven for rotation about an axis parallel to the horizontal fixed axis, a connecting rod having one end pivotally connected to the rotary member at a position biased from the axis of rotation of the rotary member, and the other end pivotally connected to the needle bar at a position below the junction of the former end and the rotary member, and a shuttle having a shuttle hook movable in synchronism with the endwise reciprocation of the needle bar to catch a loop. The rotary member and the shuttle are operatively associated with each other so that the former end of the connecting rod and the shuttle hook move in a direction opposite to the direction of swinging motion of the needle bar supporting member when said shuttle hook catches the loop. The horizontal fixed axis extends at a height below a position where the other end of the connecting rod is positioned when the shuttle hook catches the loop. With this arrangement, when the shuttle hook catches the loop with the needle positioned at both ends of the swinging motion range thereof, the needle is located at substantially the same height.

As apparent from the foregoing description, the zigzag sewing machine of the present invention need not be provided with an inverting mechanism for rotating the rotary member and the shuttle in opposite directions, respectively, and hence the zigzag sewing machine is simple in construction and requires a reduced number of parts. Furthermore, since the needle is positioned at a fixed height when the same is positioned at opposite end of its swinging motion range, the shuttle hook is able to encounter the needle at an optimum position to catch a loop.

DESCRIPTION OF THE PREFERRED EMBODIMENT

A zigzag sewing machine embodying the principles of the present invention will be described hereinafter with reference to FIGS. 1 through 3.

Figure 1:
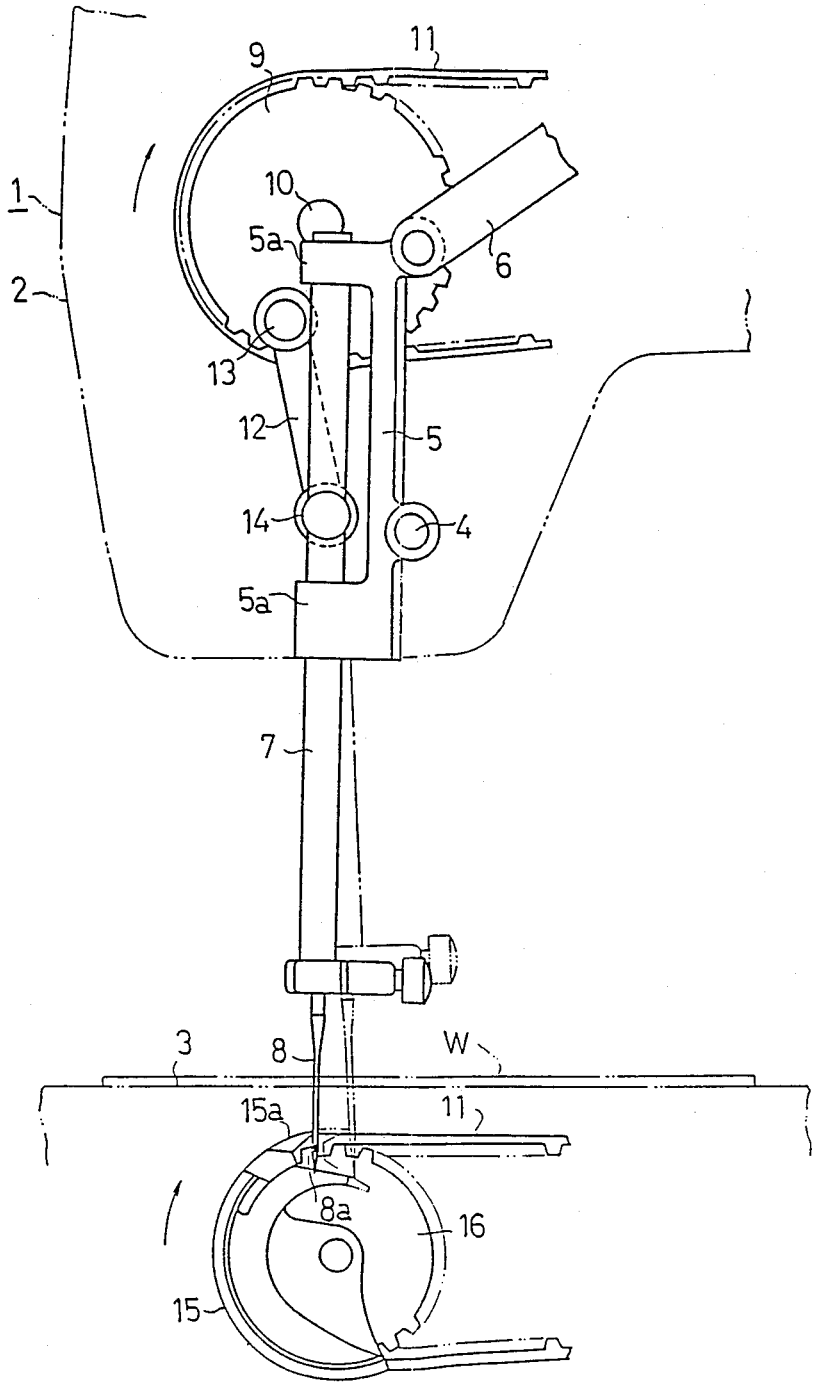
FIG. 1 is a fragmentary front elevation of a zigzag sewing machine embodying the principles of the present invention.
Figure 2:
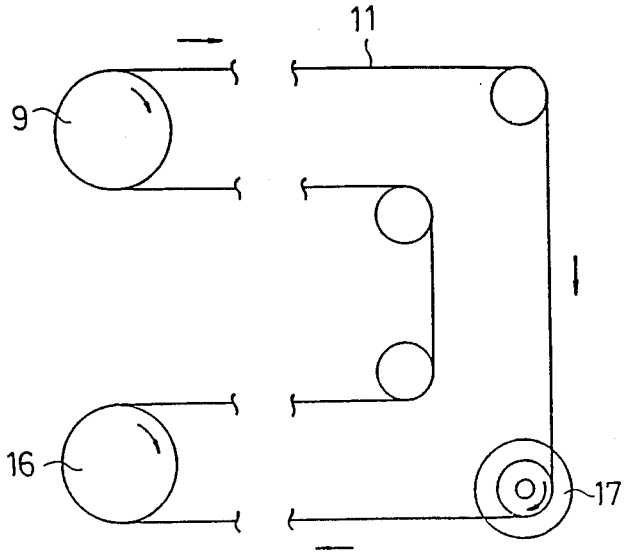
FIG. 2 is a schematic view illustrating a motion transmission system for a rotary member and the associated components.

Referring to FIG. 1, a zigzag sewing machine has a frame 1 including an arm 2 and a bed 3. A fixed supporting shaft 4 is extended horizontally within the arm 2 in a direction transversely thereof. A needle bar supporting member 5 is supported pivotally on the fixed supporting shaft 4 so as to be swung laterally on the fixed supporting shaft 4 through a connecting rod 6 by a known swinging mechanism (not shown). A needle bar 7 is supported for endwise reciprocation by a pair of upper and lower arms 5*a* of the needle bar supporting member 5, projecting to the left, as viewed in FIG. 1, and a needle 8 having an eye 8*a* is attached to the lower end of the needle bar 7.

A rotary member 9 is supported rotatably on a supporting shaft 10 disposed above and extending parallel to the fixed supporting shaft 4 within the arm 2. The rotary member 9 is rotated through a timing belt 11 by a motor 17 (FIG. 2) in a clockwise direction as viewed in FIG. 1. A connecting rod 12 has an upper end pivotally connected to the rotary member 9 with a pin 13 eccentrically secured in the front side of the rotary member 9, and a lower end pivotally connected to the needle bar 7 at a position below the upper end by means of a rotary joint 14. The rotary member 9 is rotated to reciprocate the needle bar 7 endwise through the connecting rod 12.

A shuttle 15 is provided within the bed 3 of the frame 1 for rotation about a horizontal axis extending in a direction transversely of the bed 3. The shuttle 15 has a shuttle hook 15*a* on the circumference thereof. The motion of the shuttle hook 15*a* is timed with the endwise reciprocation of the needle bar 7 so as to catch a loop formed in the eye 8*a* of the needle 8. In this embodiment, the shuttle 15 is rotated through a toothed pulley 16 by the timing belt 11 in a clockwise direction as viewed in FIG. 1. As shown in FIG. 1, when the shuttle hook 15*a* catches a loop, the upper end of the connecting rod 12, hence the pin 13, and the shuttle hook 15*a* of the shuttle 15 move in a direction opposite to the direction of swinging motion of the needle bar supporting member 5.

Figure 3:
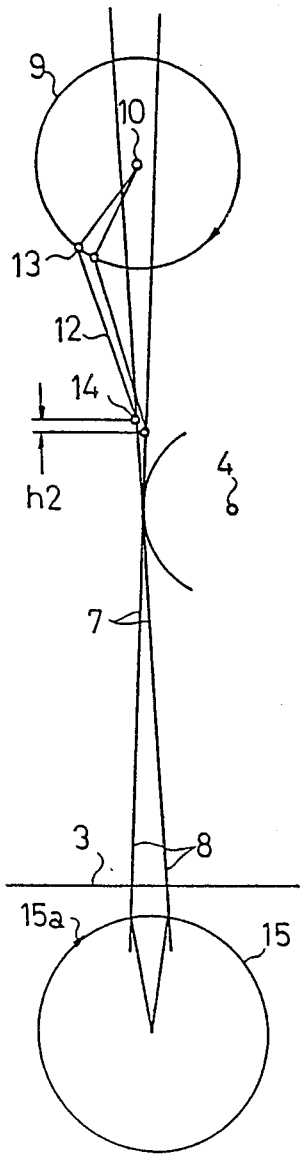
FIG. 3 is a schematic view illustrating the relation of several components of the zigzag sewing machine of FIG. 1 in the zigzag sewing operation.

As illustrated in FIGS. 1 and 3, in this embodiment, the fixed shaft 4 supporting the needle bar supporting member 5 is positioned so that the lower end of the connecting rod is located above the fixed supporting shaft 4 at a moment when the shuttle hook 15*a* of the shuttle 15 catches a loop. Furthermore, in this embodiment, the needle bar driving mechanism is designed so that the needle 8 is located substantially at a fixed vertical position when the needle 8 is located at the respective right and left ends of its lateral swinging motion range and the shuttle hook 15*a catches a loop.*

The operation of the zigzag sewing machine thus constructed will be described hereinafter.

In operation, the needle bar supporting member 5 is driven for reciprocatory swinging motion on the horizontal fixed shaft 4 by the swinging mechanism while the rotary member 9 and the shuttle 15 are rotated synchronously in the same direction through the timing belt 11 by the motor. As the rotary member 9 is rotated, the needle bar 7 is reciprocated endwise, so that the needle 8 attached to the lower end of the needle bar 7 forms zigzag stitches in cooperation with the shuttle 15 in a work W placed over the surface of the bed 3.

In this embodiment, at a moment when the shuttle hook 15*a* catches a loop during the sewing operation, the upper end of the connecting rod 12 and the shuttle hook 15*a* move in a direction opposite to the direction of swinging motion of the needle bar supporting member 5, and the lower end of the connecting rod 12 is located above the fixed shaft 4 supporting the needle bar supporting member 5. Accordingly, as shown in FIG. 3, the difference h2 between the height of the needle 8 at one end of its lateral swinging motion range where the shuttle hook 15*a* catches a loop and the height of the needle 8 at the other end where the shuttle hook 15*a* catches a loop can be reduced to enable the shuttle hook 15*a* to encounter the needle 8 at optimum positions for catching a loop.

Figure 4:
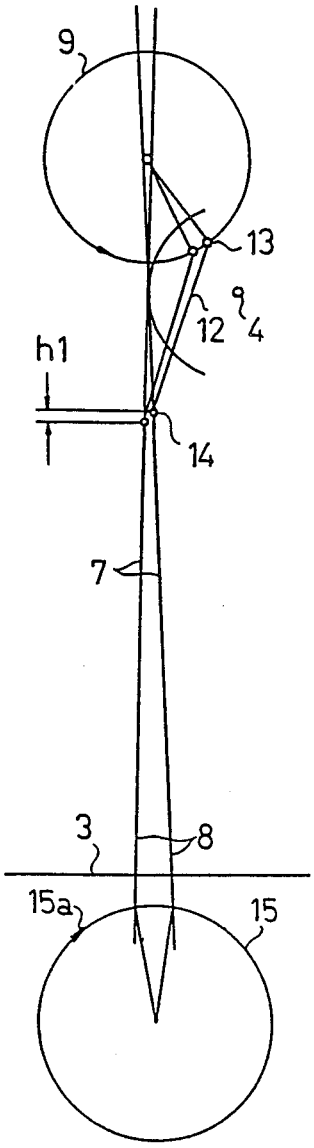
FIG.4 PRIOR ART
FIG. 4 is a schematic view similar to FIG. 3, illustrating the relation of several components of a conventional zigzag sewing machine in the zigzag sewing operation.

Furthermore, the arrangement of this embodiment, unlike the conventional arrangement shown in FIG. 4, is designed so that the rotary member 9 and the shuttle 15 rotate in the same direction, and hence the zigzag sewing machine of the present invention need not be provided with an inverting mechanism in the rotary motion transmitting system, and the rotary member 9 and the shuttle 15 can be rotated synchronously through the timing belt 11 by a single motor. Thus, the zigzag sewing machine of the present invention is simple in construction and has less component parts as compared to the conventional zigzag sewing machine.

Figure 5:
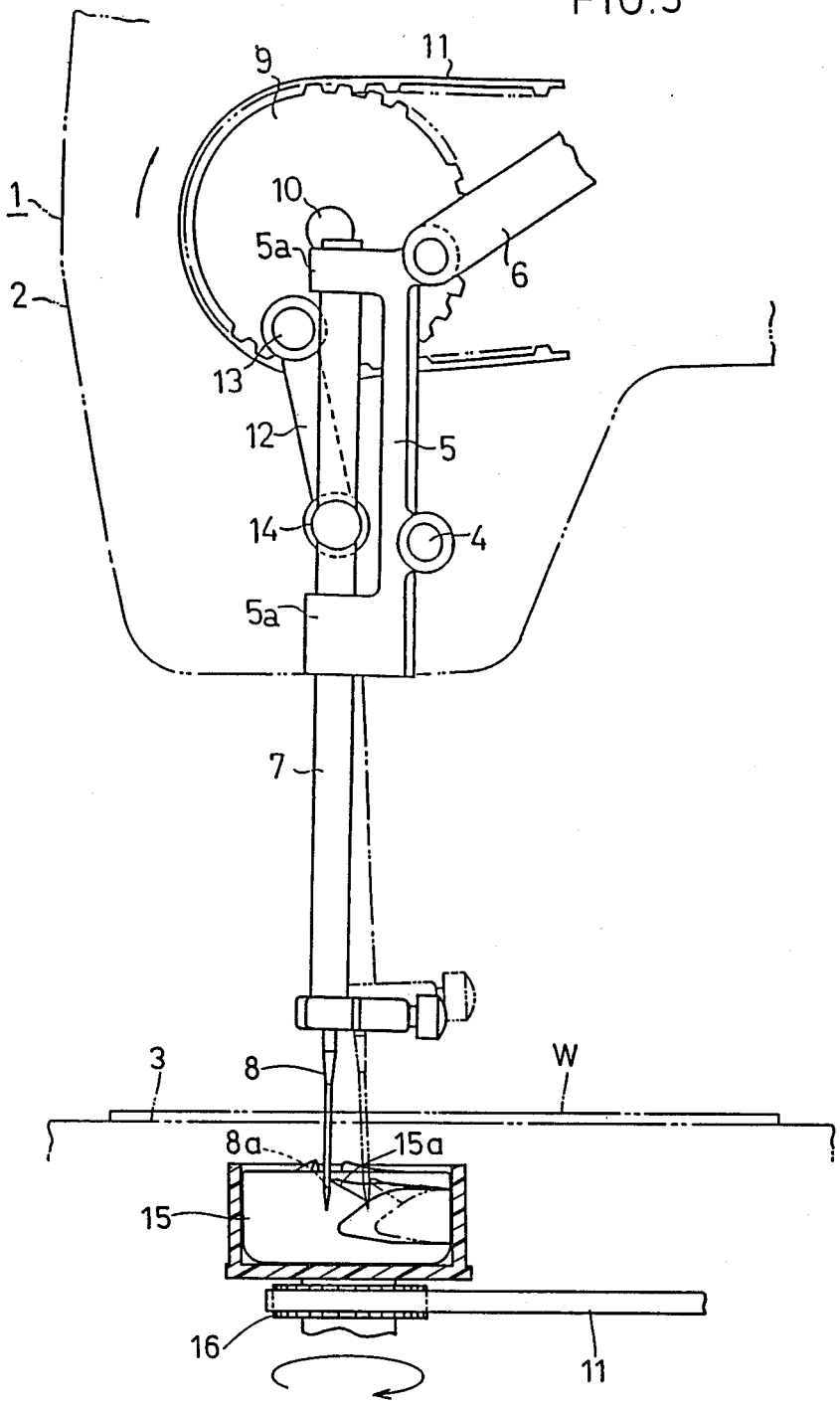
FIG. 5 is a fragmentary front elevation of another embodiment of a zigzag sewing machine embodying the principles of the present invention.

It will be appreciated that the invention is not limited to the specific type of sewing machine illustrated in the drawings, but may be used with a sewing machine of the type in which a shuttle is mounted on the machine frame for rotation about an axis perpendicular to the axis of the rotary member as is shown in the FIG. 5.

What is claimed is:

1. A zigzag sewing machine comprising a frame; a needle bar supporting member mounted on said frame for swinging motion about a horizontal fixed axis; a needle bar carried by said needle bar supporting member for endwise reciprocation, a needle carried at the lower end of said needle bar and having a thread eye; a rotary member mounted on said frame and driven for rotation about an axis parallel to said horizontal fixed axis; a connecting rod having one end pivotally connected to said rotary member at a position biased from said axis of rotation of said rotary member, and the other end pivotally connected to said needle bar at a position below the junction of the one end and said rotary member; and a shuttle having a shuttle hook movable in synchronism with the endwise reciprocation of said needle bar to catch a loop made in said eye of said needle; said rotary member and the shuttle being operatively associated with each other so that said one end of said connecting rod and said shuttle hook move in a direction opposite to each other when said shuttle hook catches said loop; said horizontal fixed axis extending at a height below a position where said other end of said connecting rod is positioned when said shuttle hook catches said loop; whereby when said shuttle hook catches said loop with said needle positioned at either end of the swinging motion range thereof, said needle is located at substantially the same height.

2. A zigzag sewing machine according to claim 1, wherein said shuttle is mounted on said frame for rotation about an axis parallel to said axis of said rotary member.

3. A zigzag sewing machine according to claim 2, wherein said rotary member is connected with said shuttle by a timing belt.

4. A zigzag sewing machine according to claim 1, wherein said shuttle is mounted on said frame for rotation about an axis perpendicular to said axis of said rotary member.

* * * * *